US011385567B2

(12) United States Patent
Hagiwara et al.

(10) Patent No.: US 11,385,567 B2
(45) Date of Patent: Jul. 12, 2022

(54) IMAGE FORMING APPARATUS WITH DEVELOPER AMOUNT PREDICTION

(71) Applicant: FUJIFILM Business Innovation Corp., Tokyo (JP)

(72) Inventors: Chihiro Hagiwara, Kanagawa (JP); Haruno Nagumo, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/325,535

(22) Filed: May 20, 2021

(65) Prior Publication Data

US 2022/0137531 A1 May 5, 2022

(30) Foreign Application Priority Data

Oct. 30, 2020 (JP) ..... JP2020-182830

(51) Int. Cl.
*G03G 15/08* (2006.01)

(52) U.S. Cl.
CPC ..... *G03G 15/0868* (2013.01); *G03G 15/0855* (2013.01); *G03G 2215/0685* (2013.01)

(58) Field of Classification Search
CPC ..... G03G 15/0868; G03G 15/0855; G03G 2215/0685
See application file for complete search history.

(56) References Cited

U.S. PATENT DOCUMENTS 5,708,917 A * 1/1998 Kawai ..... G03G 15/0849 399/42
2009/0214231 A1* 8/2009 Nagai ..... G03G 15/0893 399/27
2011/0217055 A1* 9/2011 Takehara ..... G03G 15/5058 399/27

FOREIGN PATENT DOCUMENTS

JP 2006-301537 A 11/2006

* cited by examiner

*Primary Examiner* — Susan S Lee
(74) *Attorney, Agent, or Firm* — Sughrue Mion, PLLC

(57) ABSTRACT

An image forming apparatus includes: an image carrier configured to carry an image; a developing unit configured to develop the image carried by the image carrier with a developer; and a developer replenishing unit configured to supply the developer to the developing unit, the developer replenishing unit being configured to predict, in advance, an amount of developer consumed by the image carrier at a start or an end of image formation apart from developer consumed in the image formation, to replenish the predicted amount of the developer.

11 Claims, 10 Drawing Sheets

IMAGE FORMING APPARATUS WITH DEVELOPER AMOUNT PREDICTION

CROSS-REFERENCE TO RELATED APPLICATIONS

This application is based on and claims priority under 35 USC 119 from Japanese Patent Application No. 2020-182830 filed Oct. 30, 2020.

BACKGROUND

(i) Technical Field

The present disclosure relates to an image forming apparatus.

(ii) Related Art

In the related art, a technology related to replenishment of a developer to a developing device in an image forming apparatus has already been proposed in, for example, JP-A-2006-301537.

JP-A-2006-301537 discloses a configuration including a replenishing amount predicting unit configured to predict a replenishing amount of replenishment developer that is replenished from a replenishing device to a developing device, and a forced replacing unit configured to, w % ben the replenishing amount predicted by the replenishing amount predicting unit is smaller than a predetermined value, supply toner in the developing device to an image carrier to be forcibly consumed, and to forcibly replenish the replenishing device with the replenishment developer from the replenishing device.

SUMMARY

Aspects of non-limiting embodiments of the present disclosure relate to, in an image density control operation that supplies toner to an inside of a developing device to control an image density, preventing a decrease in the image density caused by the toner consumed by adhering to a surface of an image carrier by a potential difference between the image carrier and a developer carrier at a start or end of an image forming operation.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an image carrier configured to carry an image; a developing unit configured to develop the image carried by the image carrier with a developer; and a developer replenishing unit configured to supply the developer to the developing unit, the developer replenishing unit being configured to predict, in advance, an amount of developer consumed by the image carrier at a start or an end of image formation apart from developer consumed in the image formation, to replenish the predicted amount of the developer.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments of the present disclosure will be described with reference to the accompanying drawings.

First Exemplary Embodiment

Figure 1:
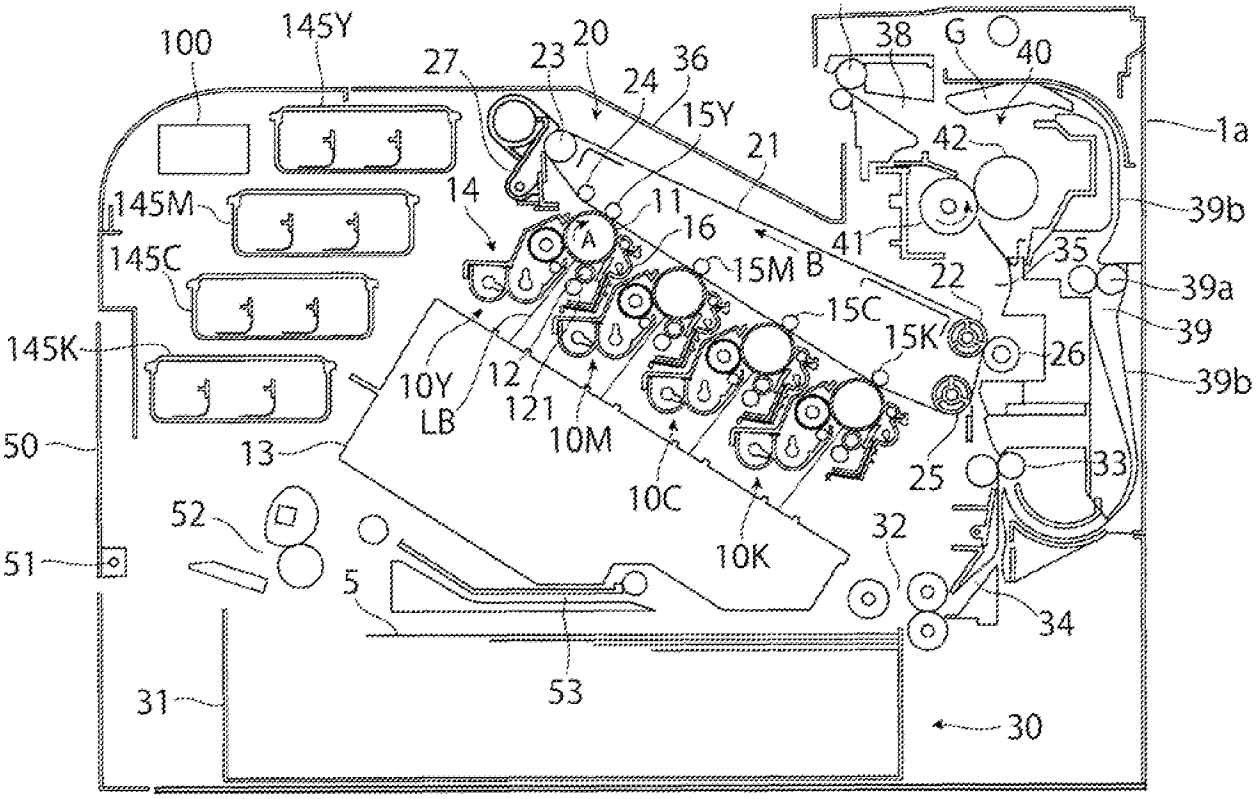
FIG. 1 is an overall configuration view illustrating an image forming apparatus according to a first exemplary embodiment of the present disclosure.
Figure 2:
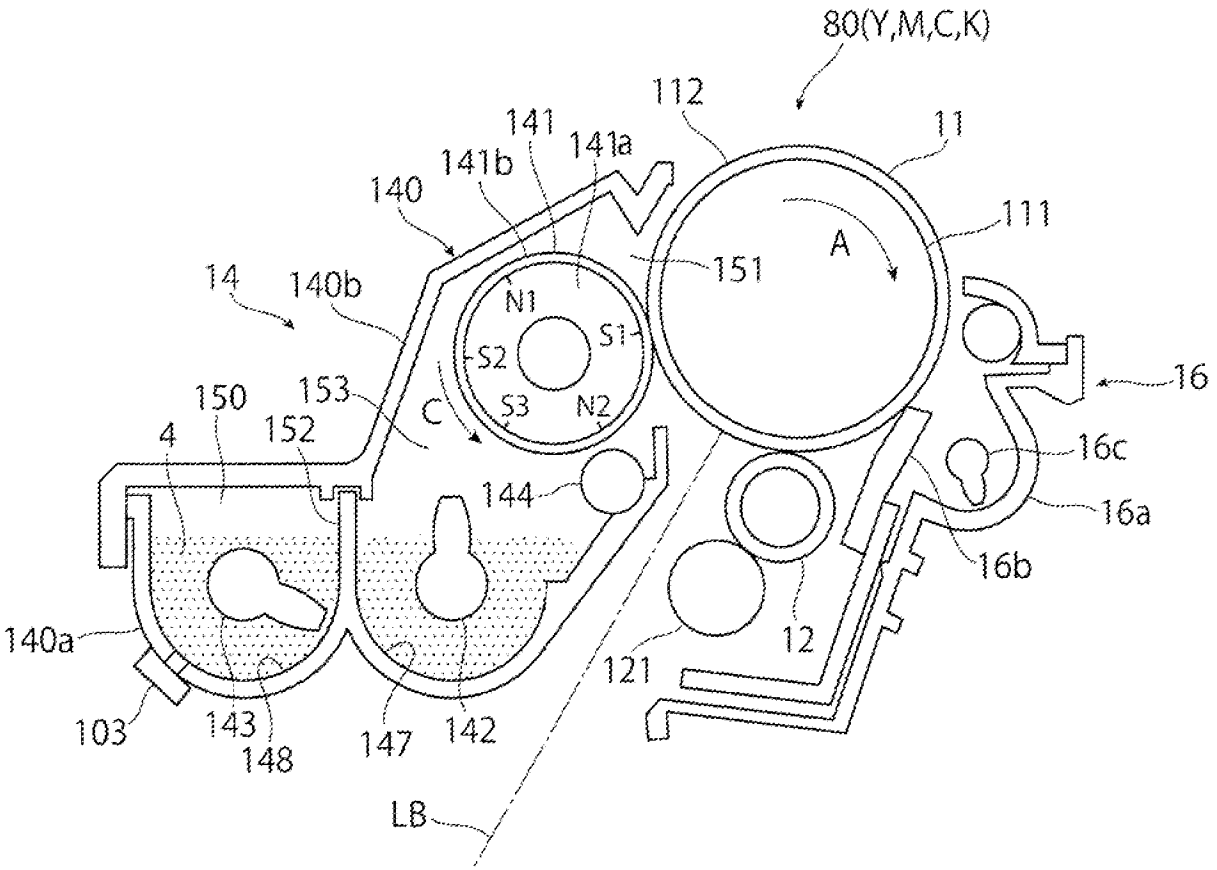
FIG. 2 is a cross-sectional configuration view illustrating a process cartridge serving as an image forming device of the image forming apparatus according to the first exemplary embodiment of the present disclosure.

FIG. 1 is a configuration view illustrating an overall outline of an image forming apparatus to which a developing device according to a first exemplary embodiment of the present disclosure is applied, and FIG. 2 is a configuration view illustrating an image forming device of the image forming apparatus.

Overall Configuration of Image Forming Apparatus

An image forming apparatus 1 according to the first exemplary embodiment is configured as, for example, a color printer. As illustrated in FIG. 1, the image forming apparatus 1 includes plural image forming devices 10 that form a toner image developed with toner that constitutes a developer, an intermediate transfer device 20 that carries the toner images formed by the respective image forming devices 10 and finally transports to a secondary transfer position at which the toner images are secondarily transferred to a recording sheet 5 as an example of a recording medium, a sheet feeding device 30 that accommodates and transports the required recording sheet 5 to be fed to the secondary transfer position of the intermediate transfer device 20, and a fixing device 40 that fixes the toner images on the recording sheet 5 secondarily transferred in the intermediate transfer device 20. The reference numeral 1*a* in the drawing indicates an apparatus body of the image forming apparatus 1. The apparatus body 1*a* includes a support structure member, an outer cover, and the like.

The image forming device 10 includes four image forming devices 10Y, 10M, 10C, and 10K that exclusively form toner images of four colors of yellow (Y), magenta (M), cyan (C), and black (K), respectively. The four image forming devices 10(Y, M, C, K) are disposed to be arranged in one row in an oblique state in the inner space of the apparatus body 1*a*.

The four image forming devices 10 include the image forming devices 10(Y, M, C) of colors of yellow (Y), magenta (M), and cyan (C), and the image forming device 10K of black (K). The black image forming device 10K is disposed on the most downstream side along a moving direction B of an intermediate transfer belt 21 of the intermediate transfer device 20. The image forming apparatus 1 has a full color mode in which the color image forming devices 10(Y, M. C) and the image forming device 10K of black (K) are operated to form a full-color image, and a black-and-white mode in which only the image forming device 10K of black (K) is operated to form a black-and-white (monochrome) image, as an image forming mode.

As illustrated in FIG. 2, each of the image forming devices 10(Y, M, C, K) includes a rotating photoconductor drum 11 as an example of an image carrier. Around the photoconductor drum 11, the following devices are disposed as examples of a toner image forming unit. The main devices are a charging device 12 that charges a circumferential surface (an image carrying surface) of the photoconductor drum 11 on which an image may be formed to a required potential, an exposure device 13 that irradiates light based on image information (signal) on the charged circumferential surface of the photoconductor drum 11 to form an electrostatic latent image (for each color) having a potential difference, a developing device 14(Y, M, C, K) that develops the electrostatic latent image into a toner image with toner of a developer of corresponding colors (Y, M, C, K), a primary transfer device 15(Y, M, C, K) (see FIG. 1) as an example of a primary transfer unit that transfers each toner image to the intermediate transfer device 20, and a drum cleaning device 16(Y, M, C, K) that removes and cleans adhering substances such as toner remaining and adhering on the image carrying surface of the photoconductor drum 11 after the primary transfer.

The photoconductor drum 11 is obtained by forming an image carrying surface having a light conductive layer (a photoconductive layer) made of a photoconductive material on a circumferential surface of a cylindrical or a columnar substrate to be grounded. The photoconductor drum 11 is supported so as to be rotated in a direction indicated by the arrow A when power is transmitted from a driving device (not illustrated).

The charging device 12 is configured as a contact type charging roller disposed in a state of being in contact with the photoconductor drum 11. A charging voltage is supplied to the charging device 12. As the charging voltage, when the developing device 14 performs reverse development, a voltage or current having the same polarity as the charging polarity of the toner supplied from the developing device 14 is supplied. A cleaning roller 121 that cleans the surface of the charging device 12 is disposed to be in contact with the rear side of the charging device 12. Examples of the charging device 12 may include a non-contact type charging device such as a Scorotron disposed on the surface of the photoconductor drum 11 in a non-contact state.

As illustrated in FIG. 1, the exposure device 13 is commonly configured in each of the image forming devices 10(Y, M, C, K), and deflects and scans a laser beam LB configured according to the image information along the axial direction of each photoconductor drum 11. As the exposure device 13, an LED print head that irradiates the photoconductor drum 11 with light according to the image information by light emitting diodes (LED) as plural light emitting elements disposed along the axial direction of the photoconductor drum 11 to form an electrostatic latent image may be used, of course.

Each of the developing devices 14(Y, M, C, K) includes a developing roller 141 that carries a developer 4 and transports the developer 4 to a developing area facing the photoconductor drum 11, a supply transport member 142 and an agitation transport member 143 such as two screw augers that transport the developer 4 so as to pass through the developing roller 141 while agitating the developer 4, and a layer thickness regulating member 144 that regulates an amount (the thickness of the layer) of the developer 4 carried on the developing roller 141, inside the device housing 140 serving as a device body in which an opening and a developer accommodating chamber are formed. In the developing device 14, a developing voltage is supplied from a power supply device (not illustrated) between the developing roller 141 and the photoconductor drum 11. Further, the developing roller 141 or the supply transport member 142 and the agitation transport member 143 is rotated in a required direction by transmitting power from a driving device (not illustrated). Further, as the four color developers 4(Y, M, C, K), a two-components developer containing non-magnetic toner and a magnetic carrier is used. The developing device 14 will be described in detail later.

The primary transfer device 15(Y, M, C, K) is a contact type transfer device having a primary transfer roller that is in contact with the periphery of the photoconductor drum 11 via the intermediate transfer belt 21 and rotates, and is supplied with a primary transfer voltage. A DC voltage having a polarity opposite to the charging polarity of the toner is supplied from a power supply device (not illustrated) as the primary transfer voltage.

The drum cleaning device 16 includes a body 16*a* having a container shape with an opening, a cleaning plate 16*b* disposed to be in contact with the circumferential surface of the photoconductor drum 11 with a required pressure after the primary transfer and removes the adhering substances such as residual toner to clean, a delivery member 16*c* such as a screw auger that recovers the adhering substances such as toner removed by the cleaning plate 16*b* and delivers the adhering substances to a recovery system (not illustrated), and the like.

As illustrated in FIG. 1, the intermediate transfer device 20 is disposed so as to be located at a position above each of the image forming devices 10(Y, M, C, K). The intermediate transfer device 20 includes the intermediate transfer belt 21 passing through a primary transfer position between the photoconductor drum 11 and the primary transfer device 15 (the primary transfer roller) and rotating in a direction indicated by the arrow B, plural belt support rollers 22 to 25 holding the intermediate transfer belt 21 in a desired state from the inner surface thereof to rotatably support, a secondary transfer device 26 as an example of a secondary transfer unit disposed on the outer peripheral surface (an image carrying surface) side of the intermediate transfer belt 21 supported by the belt support roller 22 and secondarily transferring the toner image on the intermediate transfer belt 21 to the recording sheet 5, and a belt cleaning device 27 removing and cleaning the adhering substances such as toner and paper dust remaining and adhering on the outer peripheral surface of the intermediate transfer belt 21 after passing through the secondary transfer device 26.

An endless belt made from a material in which, for example, a resistance adjusting agent such as a carbon black is dispersed in a synthetic resin such as polyimide resin or polyamide resin is used as the intermediate transfer belt 21. Further, the belt support roller 22 is configured as a rear surface support roller for the secondary transfer, the belt support roller 23 is configured as a driving roller that is rotatably driven by a driving device (not illustrated), the belt support roller 24 is configured as a surface shaping roller that forms an image formation surface of the intermediate transfer belt 21, and the belt support roller 25 is configured as a tension applying roller that applies tension to the intermediate transfer belt 21. Further, the belt support roller 23 also serves as an opposing roller facing the belt cleaning device 27.

The secondary transfer device 26 is a contact type transfer device having a secondary transfer roller rotating in contact with the peripheral surface of the intermediate transfer belt 21 in the secondary transfer position that is the outer peripheral surface portion of the intermediate transfer belt 21 supported by the belt support roller 22 of the intermediate transfer device 20, and to which a secondary transfer voltage is supplied. Further, a DC voltage having a polarity opposite to or the same as the charging polarity of the toner is supplied to the secondary transfer device 26 or the belt support roller 22 of the intermediate transfer device 20 as the secondary transfer voltage from a power supply device (not illustrated).

As illustrated in FIG. 1, the fixing device 40 includes a heating rotary body 41 having a roller form or a belt form that is rotated in the direction indicated by the arrow and is heated by a heating unit such that the surface temperature is maintained at a predetermined temperature, and a pressurizing rotary body 42 having a roller form or a belt form that rotates in accordance with the rotation of the heating rotary body 41 with being in contact with the heating rotary body 41 at a predetermined pressure in a state of substantially extending along the axial direction of the heating rotary body 41, inside a housing (not illustrated) including an introducing port and a discharging port for the recording sheet 5. In the fixing device 40, a contact portion where the heating rotary body 41 and the pressurizing rotary body 42 are in contact with each other serves as a fixing processing portion that performs necessary fixing processing (heating and pressurizing).

The sheet feeding device 30 is disposed so as to be located at a position below the image forming device 10(Y, M, C. K). The sheet feeding device 30 includes a single (or plural) sheet accommodating body 31 that accommodates the recording sheet 5 of a desired size, type, or the like in a loaded state, and a delivery device 32 that delivers the recording sheet 5 one by one from the sheet accommodating body 31. The sheet accommodating body 31 is provided such that, for example, the user of the apparatus body 1*a* may pull it out from the front surface (left side in the drawing) which is a side surface facing during an operation.

Examples of the recording sheet 5 may include, for example, a plain sheet used in an electrophotographic copying machine and printer, a thin sheet such as a tracing paper, and an OHP sheet. In order to further improve the smoothness of the image surface after fixing, it is desired that the surface of the recording sheet 5 is also as smooth as possible, and for example, a so-called thick sheet having a relatively large basis weight such as a coated sheet obtained by coating the surface of a plain sheet with resin, or an art sheet for printing may be properly used.

A sheet feeding transport path 34 including a single or plural sheet transport roller pairs 33 that transports the recording sheet 5 delivered from the sheet feeding device 30 to the secondary transfer position or a transport guide (not illustrated) is provided between the sheet feeding device 30 and the secondary transfer device 26. The sheet transport roller pair 33 disposed at a position immediately before the secondary transfer position in the sheet feeding transport path 34 is configured as, for example, a roller (registration roller) that adjusts the transport timing of the recording sheet 5. Further, a sheet transport path 35 that transports the recording sheet 5 after the secondary transfer delivered from the secondary transfer device 26 to the fixing device 40 is provided between the secondary transfer device 26 and the fixing device 40. Further, a discharge transport path 38 including a sheet discharge roller pair 37 that discharges the recording sheet 5 after fixing delivered from the fixing device 40 to a sheet discharge unit 36 provided on the upper portion of the apparatus body 1*a* is provided in a portion near the discharging port for the sheet formed in the apparatus body 1*a*.

A switching gate G switching the sheet transport path is provided between the fixing device 40 and the sheet discharge roller pair 37. The sheet discharge roller pair 37 is configured so that the rotation direction may be switched between a forward rotation direction (discharge direction) and a reverse rotation direction. When an image is formed on both sides of the recording sheet 5, after the rear end portion of the recording sheet 5 having an image on one side passes through the switching gate G, the rotation direction of the sheet discharge roller pair 37 is switched from the forward rotation direction (discharge direction) to the reverse rotation direction. The transport path of the recording sheet 5 transported in the reverse rotation direction by the sheet discharge roller pair 37 is switched by the switching gate G rotated in the counterclockwise direction in the drawing, and the recording sheet 5 is transported to a duplex transport path 39 formed along the substantially vertical direction along the rear surface of the apparatus body 1*a*. The duplex transport path 39 includes a sheet transport roller pair 39*a* transporting the recording sheet 5 in a state where the front and back sides are inverted to the sheet transport roller pair 33, a transport guide 39*b*, and the like.

In FIG. 1, the reference numeral 145(Y, M. C. K) respectively indicates a toner cartridge disposed in plural along a direction orthogonal to the sheet surface and accommodating the developer containing at least toner supplied to the corresponding developing device 14(Y, M, C, K). The toner cartridge 145(Y, M, C, K) supplies each color toner to the corresponding developing device 14(Y, M, C, K) at a predetermined timing via a toner supply device (not illustrated).

Further, the reference numeral 100 in FIG. 1 indicates a controller that collectively controls the operation of the image forming apparatus 1. The controller 100 includes a central processing unit (CPU), a read only memory (ROM), a random access memory (RAM) (not illustrated), or a bus connecting these CPU and ROM, and a communication interface.

Operation of Image Forming Apparatus

Hereinafter, descriptions will be made on a basic image forming operation by the image forming apparatus 1.

Here, an operation in the full color mode that forms a full-color image that is a combination of toner images of four colors (Y, M, C. K) using the four image forming devices 10(Y, M. C. K) will be described.

In the image forming apparatus 1, when command information of requirement for a full-color image forming operation (print) is received from an user interface or a printer driver (both are not illustrated), the four image forming devices 10(Y, M, C. K), the intermediate transfer device 20, the secondary transfer device 26, the fixing device 40, and the like are started.

Then, as illustrated in FIGS. 1 and 2, in each of the image forming devices 10(Y, M, C, K), each photoconductor drum 11 first rotates in the direction indicated by the arrow A. and each charging device 12 charges the surface of each photoconductor drum 11 at a required polarity (negative polarity in the first exemplary embodiment) and potential. Subsequently, the exposure device 13 irradiates the laser beam LB which is deflected and scanned based on an image signal obtained by converting the image information input to the image forming apparatus 1 into the respective color components (Y, M, C, K) to the surface of the photoconductor drum 11 after charging, thereby forming an electrostatic latent image of each color component formed with a required potential difference on the surface.

Subsequently, each of the image forming devices 10(Y, M, C, K) supplies toner of the corresponding color (Y, M, C, K) charged to the required polarity (negative polarity) from the developing roller 141 to cause the toner electrostatically to adhere to the electrostatic latent image of the corresponding color component formed on the photoconductor drum 11 for development. By this development, the electrostatic latent image of each color component formed on each photoconductor drum 11 is developed as toner images of the four colors (Y, M, C, K) respectively developed with toner of the corresponding color.

Subsequently, when the toner image of each color of the respective image forming devices 10(Y, M, C, K) formed on the photoconductor drum 11 is transported to the primary transfer position, the primary transfer device 15(Y, M, C, K) primarily transfers the toner image of each color in a sequentially overlapped state with respect to the intermediate transfer belt 21 of the intermediate transfer device 20 rotating in the direction indicated by the arrow B.

Further, in each of the image forming devices 10(Y, M, C, K) in which the primary transfer is completed, the drum cleaning device 16 removes the adhering substances by scraping to clean the surface of the photoconductor drum 11. Therefore, each of the image forming devices 10(Y, M, C. K) becomes a state where the next image forming operation is possible.

Subsequently, the intermediate transfer device 20 carries the toner image primarily transferred and transports the toner image to the secondary transfer position by the rotation of the intermediate transfer belt 21. Meanwhile, the sheet feeding device 30 delivers the required recording sheet 5 to the sheet feeding transport path 34 in accordance with the image forming operation. In the sheet feeding transport path 34, the sheet transport roller pair 33 serving as a registration roller delivers and feeds the recording sheet 5 to the secondary transfer position in accordance with a transfer timing.

In the secondary transfer position, the secondary transfer device 26 secondarily transfers the toner image on the intermediate transfer belt 21 collectively to the recording sheet 5. Further, in the intermediate transfer device 20 in which the secondary transfer is completed, the belt cleaning device 27 removes the adhering substances such as toner remaining on the surface of the intermediate transfer belt 21 after the secondary transfer to clean.

Subsequently, the recording sheet 5 to which the toner image is secondarily transferred is separated from the intermediate transfer belt 21, and then transported to the fixing device 40 through the sheet transport path 35. In the fixing device 40, the recording sheet 5 after the secondary transfer is introduced into and passed through the contact portion between the heating rotary body 41 and the pressurizing rotary body 42 that are rotating, and thus, an unfixed toner image is fixed on the recording sheet 5 by performing the necessary fixing processing (heating and pressurizing). Finally, when the image forming operation in which an image is formed on one surface is performed, the recording sheet 5 after completing the fixing is discharged to the sheet discharge unit 36 provided in the upper portion of the apparatus body 1*a* by the sheet discharge roller pair 37.

By the above operation, the recording sheet 5 on which a full-color image formed by combining toner images of four colors is formed is output.

The recording sheet 5 on which a monochrome image is formed is output by operating only the image forming device 10K of black (K).

Configuration of Process Cartridge

In the exemplary embodiment, a process cartridge 80(Y, M, C. K) as an example of an image forming unit is configured by integrally unitizing and assembling the image forming member including the photoconductor drum 11, the charging device 12 disposed around the photoconductor drum 11, the developing device 14, and the drum cleaning device 16.

FIG. 2 is a cross-sectional configuration view illustrating the process cartridge 80 that constitutes the image forming device of the image forming apparatus.

As illustrated in FIG. 2, the process cartridge 80 includes a process cartridge body as an example of an image forming unit body in which the photoconductor drum 11, the charging device 12, the developing device 14, and the drum cleaning device 16 are integrally unitized and mounted. In the illustrated exemplary embodiment, the process cartridge body includes the device housing 140 of the developing device 14 or the body 16*a* of the drum cleaning device 16, further, frame members (not illustrated) disposed on the front end portion and the inner end portion of the process cartridge 80 along the mounting direction, and the like.

Figure 3:
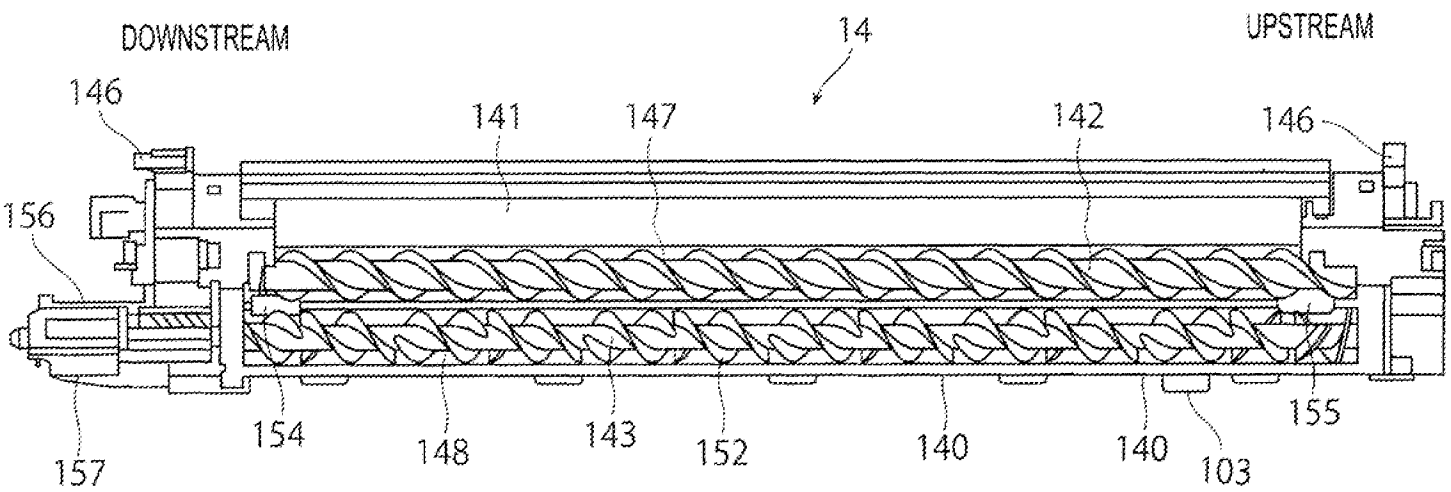
FIG. 3 is a cross-sectional configuration view illustrating a developing device.

The photoconductor drum 11 is rotatably mounted to the frame member (not illustrated) of the process cartridge body. Meanwhile, as illustrated in FIG. 3, in the developing device 14, the developing roller 141 is swingable in a direction in which the developing roller 141 comes into contact with and separates from the photoconductor drum 11, with a swing fulcrum 146 as the center with respect to the process cartridge body. Further, in the developing device 14, the developing roller 141 is pressurized to be in contact with the surface of the photoconductor drum 11 by an elastic member such as a coil spring (not illustrated) that is hooked between the device housing 140 of the developing device 14 and the frame member of the process cartridge body to which the photoconductor drum 11 is rotatably mounted.

Configuration of Developing Device

FIGS. 2 and 3 are cross-sectional configuration views respectively illustrating the process cartridge including the developing device and the developing device according to the first exemplary embodiment.

As illustrated in FIGS. 2 and 3, the developing device 14 includes the device housing 140 as an example of a device body of the developing device 14. When roughly classifying, the device housing 140 includes a lower housing 140*a* disposed at the lower portion of the developing device 14 and an upper housing 140*b* disposed at the upper portion of the developing device 14. The lower housing 140*a* and the upper housing 140*b* are airtightly joined with each other, and as illustrated in FIG. 2, a developer accommodating chamber 150 that accommodates the two-components developer 4 is formed inside the device housing 140. An opening 151 is provided in the area of the device housing 140 facing to the photoconductor drum 11. Further, inside the device housing 140, the developing roller 141 as an example of a developer carrier is disposed to be rotatable along the arrow direction C to be partially exposed to the opening 151. The developing roller 141 includes a magnet roller 141*a* as an example of a magnetic field generating unit that is fixedly disposed inside, and in which a magnetic pole having the required polarity is disposed at the required position along the circumferential direction, and a cylindrical developing sleeve 141*b* as an example of a developer transport member disposed on the outer periphery of the magnet roller 141*a* to be rotatable at a required rotational speed along the direction of the arrow C. The developing sleeve 141*b* is formed in a cylindrical shape by a non-magnetic material made of aluminum, non-magnetic stainless steel, or the like.

In the first exemplary embodiment, the rotation direction of the developing sleeve 141*b* is set to a direction opposite to the rotation direction of the photoconductor drum 11. That is, while the rotation direction A of the photoconductor drum 11 is set to the clockwise direction as illustrated in FIG. 2, the rotation direction C of the developing sleeve 141*b* is set to the counterclockwise direction. As a result, the outer peripheral surface of the developing sleeve 141*b* moves in the same direction as the movement direction of the surface of the photoconductor drum 11 in the developing area facing the photoconductor drum 11. The rotation direction of the developing sleeve 141*b* may be set to the same direction as the rotation direction A of the photoconductor drum 11.

The rotation speed of the developing sleeve 141*b* is determined in accordance with the productivity of the image forming apparatus 1 determined by the rotation speed (process speed) of the photoconductor drum 11. The productivity of the image forming apparatus 1 is indicated by, for example, the number of recording sheets 5 having A4 size (LEF) on which an image may be formed per unit time.

The magnet roller 141*a* includes a developing magnetic pole S1 disposed at a position that is a developing area facing to the photoconductor drum 11 and is slightly displaced upstream side along the rotation direction of the photoconductor drum 11 from the closest position, a transport magnetic pole N1 positioned at the end portion on the downstream side along the rotation direction of the developing sleeve 141*b* in the opening 151 of the device housing 140 and transporting the developer 4 that is disposed to be adjacent to the downstream side of the developing magnetic pole S1 along the rotation direction of the developing sleeve 141*b* and used for developing to the inside of the device housing 140, a pick-off magnetic pole S2 disposed on the downstream side of the transport magnetic pole N1 along the rotation direction of the developing sleeve 141*b*, serving as a transport magnetic pole that transports the developer 4 to the inside of the device housing 140 together with the transport magnetic pole N1, and separating the developer 4 from the surface of the developing sleeve 141*b*, a pick-up magnetic pole S3 disposed on the downstream side of the pick-off magnetic pole S2 along the rotation direction of the developing sleeve 141*b* and adsorbing the new developer 4 supplied while being agitated by the supply transport member 142 to the surface of the developing sleeve 141*b*, and a trimming magnetic pole N2 disposed on the downstream side of the pick-up magnetic pole S3 along the rotation direction of the developing sleeve 141*b* and uniformalizing the developer layer together with the layer thickness regulating member 144. The layer thickness regulating member 144 that regulates the amount (layer thickness) of the developer 4 carried on the surface of the developing sleeve 141*b* is disposed at the position facing the trimming magnetic pole N2 of the magnet roller 141*a*. The layer thickness regulating member 144 is made of a magnetic material formed in a columnar shape, and regulates the layer thickness of the developer 4 to a required value in a state where the magnetic force of the trimming magnetic pole N2 acts. The developer 4 that is transported while being adsorbed by the magnetic poles of the magnet roller 141*a* forms a layer in a magnetic brush form on the surface of the developing sleeve 141*b*.

Inside the device housing 140, the supply transport member 142 as an example of a developer supply unit including, for example, a screw auger (supply auger) that pumps the developer 4 accommodated inside the developer accommodating chamber 150 and supplies the developer 4 to the developing roller 141 is disposed below obliquely along the vertical direction of the developing roller 141. The supply transport member 142 is rotatably driven in the counterclockwise direction by a driving device (not illustrated). Further, inside the device housing 140, the agitation transport member 143 as an example of a developer transport unit including, for example, a screw auger (admix auger) that transports the developer 4 supplied to the inside of the device housing 140 while agitating the developer 4 is disposed on the rear surface of the supply transport member 142. The agitation transport member 143 is also rotatably driven in the clockwise direction by a driving device (not illustrated).

The lower housing 140*a* is provided with a first accommodating portion 147 and a second accommodating portion 148 formed in a substantially semi-cylindrical cross-sectional shape in order to accommodate the supply transport member 142 and the agitation transport member 143. The first accommodating portion 147 and the second accommodating portion 148 are partitioned by a partition wall 152 provided in the lower housing 140*a*. Further, the upper housing 140*b* is provided with a third accommodating portion 153 that accommodates the developer 4 together with the first accommodating portion 147 of the lower housing 140*a* and supplies the developer 4 to the developing roller 141. In FIGS. 2 and 3, the reference numeral 103 indicates a toner concentration sensor that detects the toner concentration of the developer 4 accommodated inside the device housing 140.

Further, as illustrated in FIG. 3, at both end portions of the partition wall 152 along the longitudinal direction, a first passage 154 and a second passage 155 that transport the developer 4 between the supply transport member 142 and the agitation transport member 143 are provided, respectively. Further, the inner end portion of the agitation transport member 143 along the axial direction extends to protrude toward the rear surface of the device housing 140. A supply unit 156 having a substantially cylindrical shape is provided in the extending portion of the agitation transport member 143. Further, in the supply unit 156 having a cylindrical shape, a supply port 157 through which the developer 4 of the corresponding color is supplied from the toner cartridge 145(Y, M, C, K) is opened. The supply port 157 is covered with a shutter member (not illustrated) to be opened/closed.

In the meantime, in the developing device 14, the toner in the developer 4 accommodated inside the device housing 140 is consumed by developing the electrostatic latent image formed on the surface of the photoconductor drum 11, and is gradually decreased.

As a result, in the image forming apparatus 1, the pixel amount of the image (electrostatic latent image) formed on the surface of the photoconductor drum 11 of each image forming device 10(Y, M, C, K) by the exposure device 13 is counted and the toner concentration of the developer 4 accommodated in the developing device 14 is directly or indirectly measured. Then, the toner amount supplied from the toner cartridge 145(Y, M, C, K) via a toner supply device (not illustrated) to the developing device 14 is controlled based on the pixel amount of the image (electrostatic latent image) formed on the surface of the photoconductor drum 11 and the toner concentration of the developer 4 in the developing device 14.

Figure 4:
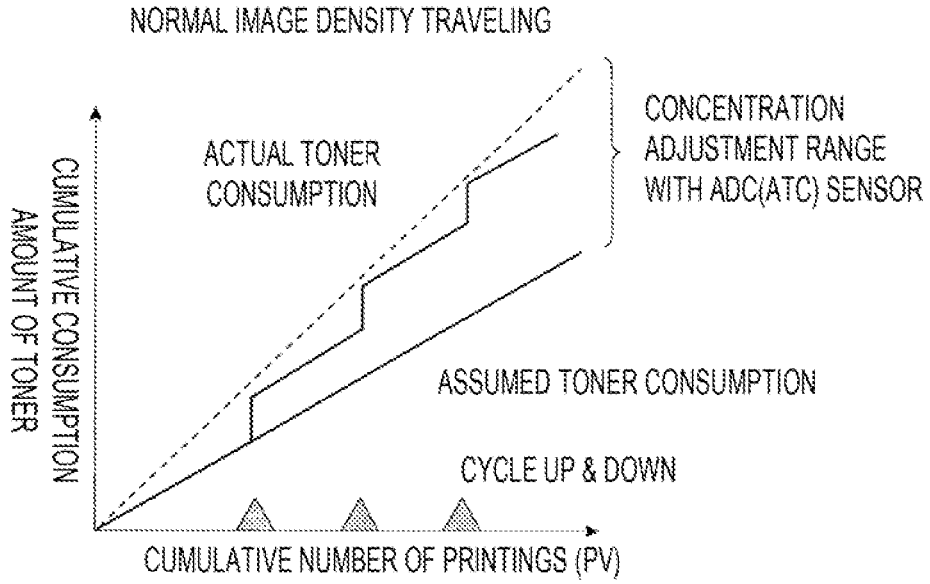
FIG. 4 is a graph illustrating a relationship between a cumulative number of printings and a cumulative consumption amount of toner.

At this time, when the image (electrostatic latent image) formed on the surface of each photoconductor drum 11 has a normal image density, as illustrated in FIG. 4, the cumulative consumption amount of the toner is within the range controlled by a toner concentration control operation, and thus, the decrease in the image density caused by the insufficient supply of the toner to the developing device 14 does not occur.

Figure 5:
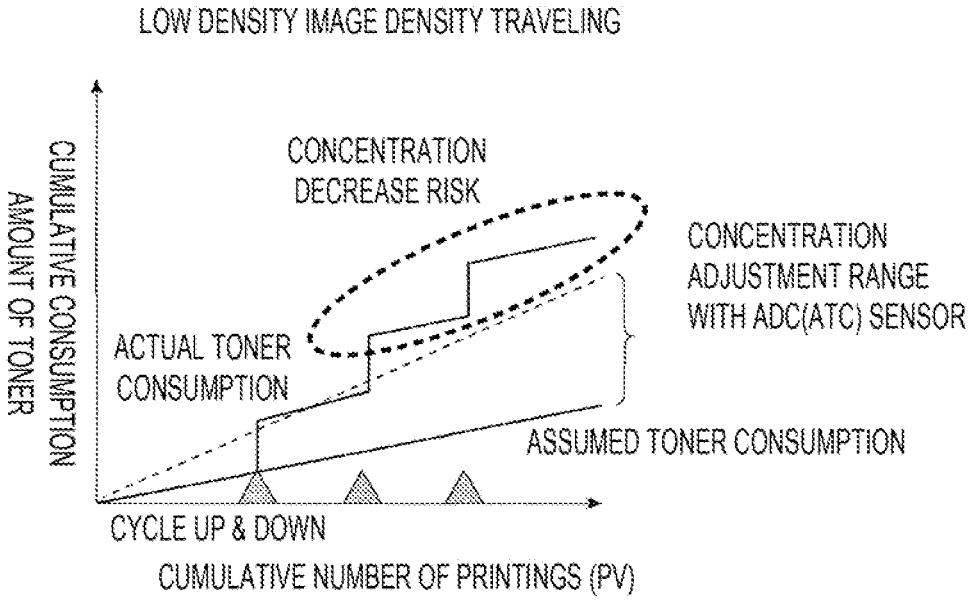
FIG. 5 is a graph illustrating a relationship between a cumulative number of printings and a cumulative consumption amount of toner.

In FIGS. 4 and 5, cycle up & down indicated represents an operation in which, when a series of image forming operations is started in the image forming apparatus 1, the photoconductor drum 11 or the developing device 14 is driven, and the surface of the photoconductor drum 11 is charged to a required charging potential by the charging device 12, and a developing bias voltage is applied to the developing roller 141 of the developing device 14.

Further, when a series of image forming operations is ended in the image forming apparatus 1, the photoconductor drum 11 or the developing device 14 is stopped, and when the photoconductor drum 11 or the developing device 14 is stopped, the charging of the surface of the photoconductor drum 11 by the charging device 12 or the application of the developing bias voltage to the developing roller 141 of the developing device 14 is stopped.

When a series of image forming operations is started or ended in this image forming apparatus 1, when the surface potential of the photoconductor drum 11 is suddenly raised or lowered by the charging device 12 or when the developing bias voltage applied to the developing roller 141 of the developing device 14 is suddenly raised or lowered, due to the potential difference between the surface potential of the photoconductor drum 11 and the developing bias voltage of the developing roller 141, a technical problem called bead carry-over occurs in which carriers in the developer 4 adhering to the developing roller 141 adhere to the surface of the photoconductor drum 11.

Therefore, in the image forming apparatus 1, when a series of image forming operations is started or ended, the carriers in the developer 4 are prevented or suppressed from adhering to the surface of the photoconductor drum 11 by raising or lowering the surface potential of the photoconductor drum 11 and the developing bias voltage of the developing roller 141 with a required potential difference.

However, as described above, in the image forming apparatus 1, when a series of image forming operations is started or ended, the carriers in the developer 4 may be prevented or suppressed from adhering to the surface of the photoconductor drum 11 by raising or lowering the surface potential of the photoconductor drum 11 and the developing bias voltage of the developing roller 141 with a required potential difference. On the other hand, the toner charged in the polarity opposite to the carrier is transferred and adhering to the surface of the photoconductor drum 11, and thus, the toner in the developing device 14 is consumed.

As a result, in the image forming apparatus 1, when the image (electrostatic latent image) formed on the surface of each photoconductor drum 11 is an image having a low image density lower than a normal image density, as illustrated in FIG. 5, due to the toner consumed at the start or end of a series of image forming operations, the cumulative consumption amount of the toner is out of the range controlled by the toner concentration control operation at a low image density, and as a result, there is a technical problem of causing a decrease in image density.

Therefore, the image forming apparatus 1 according to the first exemplary embodiment includes a developer replenishing unit that supplies the developer to the developing unit, and predicts, in advance, an amount of developer consumed by the image carrier at a start or an end of image formation, or both the start and the end of the image formation apart from developer consumed in the image formation, to replenish the predicted amount of the developer.

Further, in the image forming apparatus 1 according to the first exemplary embodiment, the developer replenishing unit predicts the amount of the developer consumed by the image carrier at the start or end of the image formation or both the start and the end of the image formation apart from the developer consumed in the image formation, in accordance with the characteristics of the developer, to replenish the predicted amount of the developer.

Further, in the image forming apparatus 1 according to the first exemplary embodiment, when the density of the image carried by the image carrier is equal to or less than a predetermined density, the developer replenishing unit predicts, in advance, the amount of the developer consumed by the image carrier apart from the developer consumed in the image formation to replenish the predicted amount of the developer.

Figure 6:
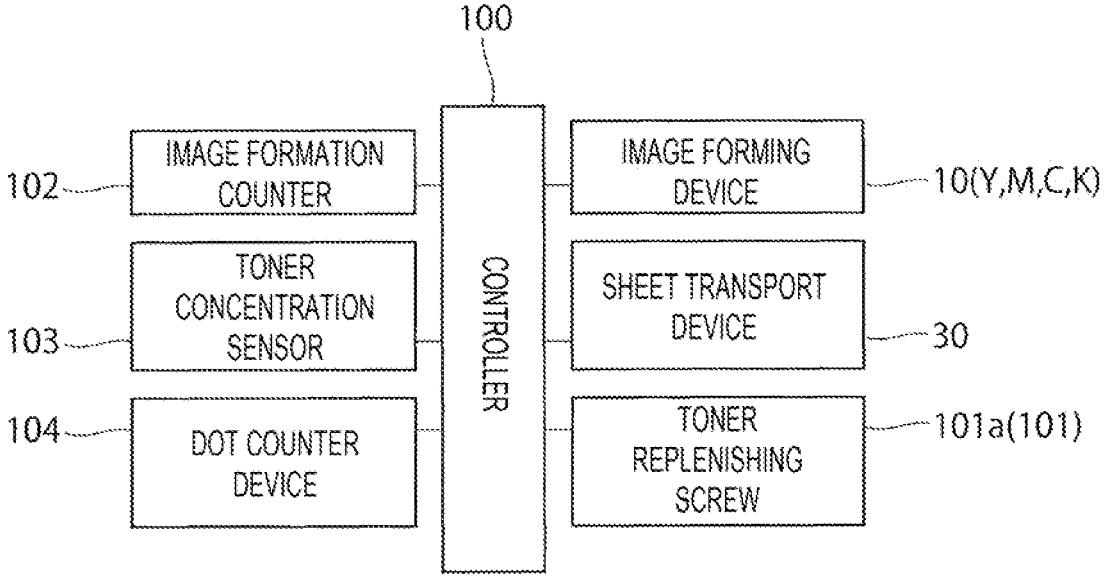
FIG. 6 is a block diagram illustrating a controller of the image forming apparatus according to the first exemplary embodiment of the present disclosure.

FIG. 6 is a block diagram illustrating a controller 100 of the image forming apparatus 1 according to the first exemplary embodiment.

In FIG. 6, the reference numeral 100 indicates the controller of the image forming apparatus 1, the reference numeral 10(Y, M, C, K) indicates each of the image forming devices of yellow (Y), magenta (M), cyan (C), and black (K), the reference numeral 30 indicates the sheet transport device, the reference numeral 101*a* indicates a toner replenishing screw that transports toner of a toner replenishing device 101 that replenishes the developing device 14(Y, M, C, K) with toner from each of the toner cartridges 145(Y, M, C, K) of yellow (Y), magenta (M), cyan (C), and black (K), the reference numeral 102 indicates an image formation counter that counts the number of recording sheets 5, which is the number of images formed in the image forming apparatus 1, the reference numeral 103 indicates a toner concentration sensor that detects the toner concentration in the developer 4 provided in the developing device 14 of each of the image forming devices 10(Y, M, C, K), and the reference numeral 104 indicates a dot counter device that counts the dot, which is an amount of pixels (number of pixels) of the image formed on the surface of the photoconductor drum 11 of each of the image forming devices 10(Y, M, C, K).

Effect of Image Forming Apparatus

In the image forming apparatus 1 according to the first exemplary embodiment, as described in the following, in an image density control operation that supplies toner to the inside of the developing device to control an image density, the decrease in the image density caused by the toner that is consumed by adhering to the surface of the image carrier by the potential difference between the image carrier and the developer carrier at the start or end of the image forming operation is prevented.

Figure 7:
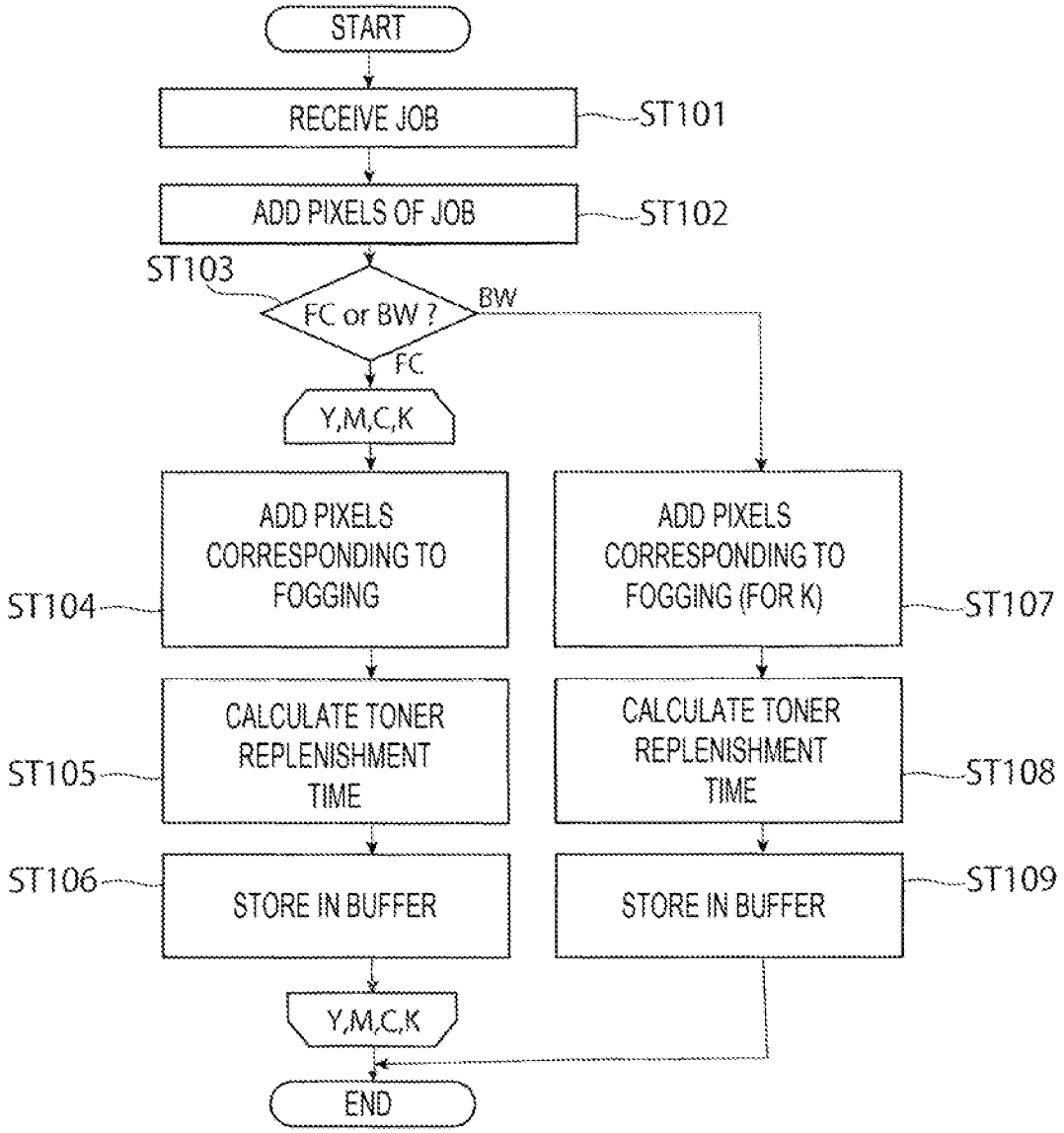
FIG. 7 is a flowchart of a toner replenishing operation of the image forming apparatus according to the first exemplary embodiment of the present disclosure.

That is, in the image forming apparatus 1 according to the first exemplary embodiment, as illustrated in FIG. 7, when command information (job) for requesting a full color or a monochrome image forming operation (print) from a user interface or a printer driver (both are not illustrated) is received (step 101), the controller 100 adds (cumulatively counting) the number of pixels, which is the image information of the received print command (step 102).

Here, the number of pixels, which is the image information of the received print command, is, for example, the number of pixels in consideration of a desired resolution (for example, 400 dpi or 600 dpi, or 1,200 dpi), and a desired tonality (for example, 256 tones), based on the image information of the print command on the A4 size recording sheet 5.

Subsequently, the controller 100 determines whether the print command is for full color or monochrome (step 103), and when it is determined to full color, pixels corresponding to fogging are added to each of the image forming devices 10(Y, M, C, K) of yellow (Y), magenta (M), cyan (C), and black (K) (step 104).

Here, pixels corresponding to fogging represents the toner that is predicted to be consumed at the start or the end of a series of jobs (image forming operations) as the number of pixels. The addition of the pixels corresponding to fogging is performed for each developing device 14 of each of the image forming devices 10(Y, M, C, K) of yellow (Y), magenta (M), cyan (C), and black (K) used in the image determined to be a full-color image. Then, the controller 100 calculates the toner replenishment time (step 105), and respectively stores the toner replenishment time, which is the calculated result, in a buffer as an example of a storage unit (not illustrated) provided in each developing device 14 of yellow (Y), magenta (M), cyan (C), and black (K) (step 106).

When it is determined to be full color, the controller 100 executes the above-described processing for each color of yellow (Y), magenta (M), cyan (C), and black (K).

Meanwhile, when it is determined that the print command is for monochrome, the controller 100 adds the pixel corresponding to fogging to black (K) (step 107), calculates the toner replenishment time (step 108), stores the toner replenishment time, which is the calculated result, in the buffer as an example of a storage unit (not illustrated) provided in the developing device 14 of black (K) (step 109), and ends the processing.

The controller 100 executes the above processing until the print command of the example is ended.

Further, the controller 100 executes a calculation operation of the toner replenishment time according to the toner concentration in the developing device 14, apart from a calculation operation of the toner replenishment time according to the number of pixels of the image described above. The calculation operation of the toner replenishment time according to the toner concentration in the developing device 14 may be executed at a timing different from the calculation operation of the toner replenishment time according to the number of pixels of the image, or at the same timing as the calculation operation of the toner replenishment time according to the number of pixels of the image.

Figure 8:
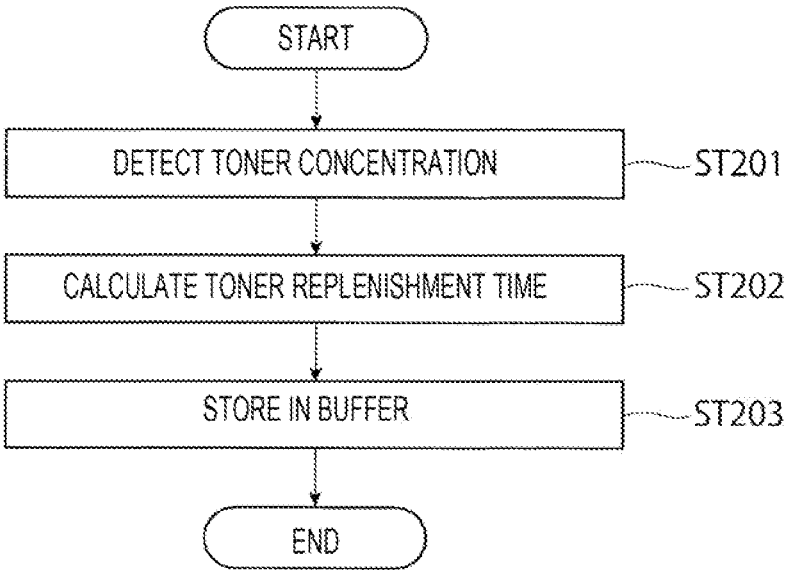
FIG. 8 is a flowchart of the toner replenishing operation of the image forming apparatus according to the first exemplary embodiment of the present disclosure.

When the calculation operation of the toner replenishment time according to the toner concentration in the developing device 14 is executed, as illustrated in FIG. 8, the controller 100 detects the toner concentration of the developer 4 accommodated in the device housing 140 for each of the developing devices 14 of yellow (Y), magenta (M), cyan (C), and black (K) by the toner concentration sensor 103 (step 201).

Subsequently, the controller 100 respectively calculates the toner replenishment time for replenishing each of the developing devices 14 of yellow (Y), magenta (M), cyan (C), and black (K) based on the toner concentration in each detected developing device 14 (step 202), and then, stores the calculated toner replenishment time for replenishing each developing device 14 in the buffer (not illustrated) provided corresponding to each developing device 14 (step 203), and ends the processing.

Figure 9:
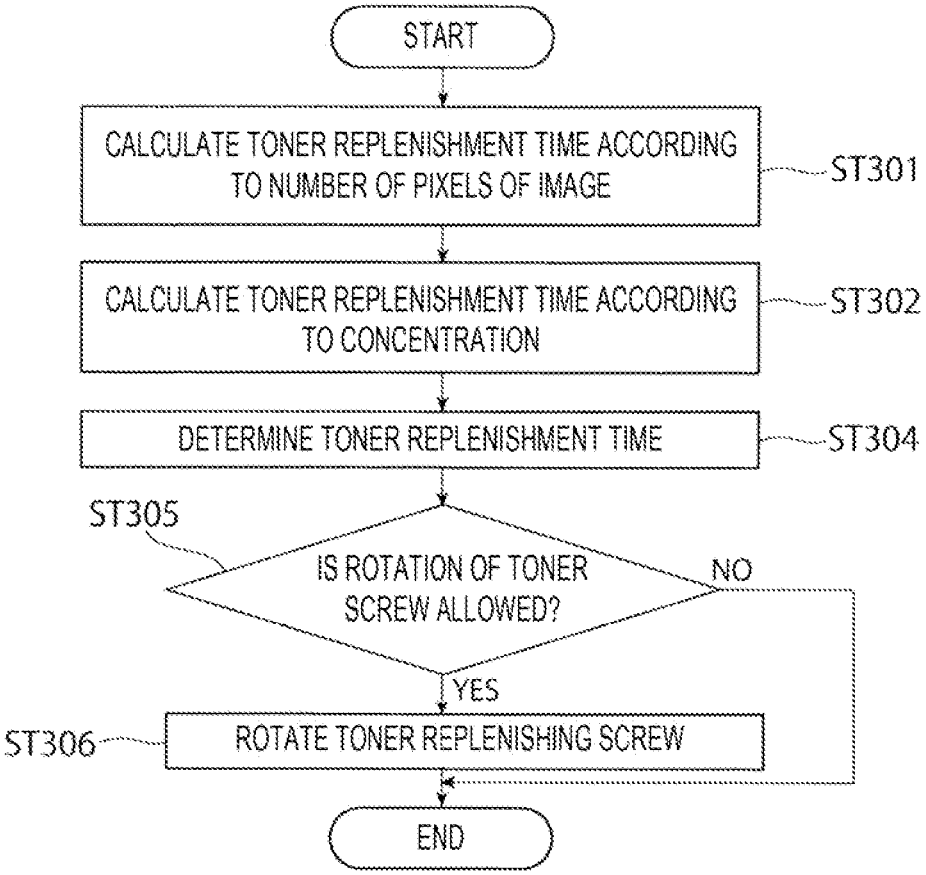
FIG. 9 is a flowchart of the toner replenishing operation of the image forming apparatus according to the first exemplary embodiment of the present disclosure.

Then, as illustrated in FIG. 9, when it is determined to be a predetermined toner replenishment timing such as the start or the end of the print operation, or when an image is formed on the required number of recording sheets 5, the controller 100 executes the toner replenishing operation.

In the toner replenishing operation, the controller 100 reads and calculates the toner replenishment time according to the number of pixels of the image from the buffer (not illustrated) provided corresponding to each of the developing devices 14 of yellow (Y), magenta (M), cyan (C), and black (K) (step 301).

Subsequently, the controller 100 reads and calculates the toner replenishment time corresponding to the toner concentration of each of the developing devices 14 of yellow (Y), magenta (M), cyan (C) and black (K) from the buffer (not illustrated) (step 302).

Then, the controller 100 adds the toner replenishment time according to the number of pixels of the image read from the buffer (not illustrate) provided corresponding to each of the developing devices 14 of yellow (Y), magenta (M), cyan (C), and black (K), and the toner replenishment time corresponding to the toner concentration of each of the developing devices 14 of yellow (Y), magenta (M), cyan (C), and black (K) to determine the toner replenishment time for replenishing each of the developing devices 14 (step 302 and step 304).

The controller 100 determines whether it is the timing at which the toner replenishing operation is allowed (step 305), and, when it is determined to be the timing at which the toner replenishing operation is allowed, executes the toner replenishing operation (step 306).

Here, as the determining whether or not it is the timing at which the toner replenishing operation is allowed, since the image density may fluctuate when the toner is replenished to the developing device 14 while performing the image forming operation, for example, in a case where any one of the image forming devices 10 of yellow (Y), magenta (M), cyan (C), and black (K) is performing the image forming operation, a processing that does not allow the toner replenishing operation is performed.

Meanwhile, when it is determined that it is not the timing at which the toner replenishing operation is allowed, the controller 100 ends the processing without executing the toner replenishing operation.

As described above, in the image forming apparatus 1 configured as described above, when the toner replenishment time for supplying to each of the developing devices 14 of yellow (Y), magenta (M), cyan (C), and black (K) is calculated according to the number of pixels of the image, it is considered adding the pixels corresponding to fogging, which is the toner to be consumed, due to the start and the stop of the print job. As a result, the image forming apparatus 1 executes the toner replenishing operation including the toner to be consumed, due to the start and the stop of the print job.

The image forming apparatus 1 does not necessarily need to add the pixels corresponding to fogging, which is the toner to be consumed, due to both the start and the stop of the print job. For example, in a case where there is a difference in the toner amount consumed due to the start and the stop of the print job, and one is largely smaller than the other one, the image forming apparatus 1 may add the pixels corresponding to fogging, which is the toner to be consumed, due to one of the start and the stop of the print job.

Figure 10:
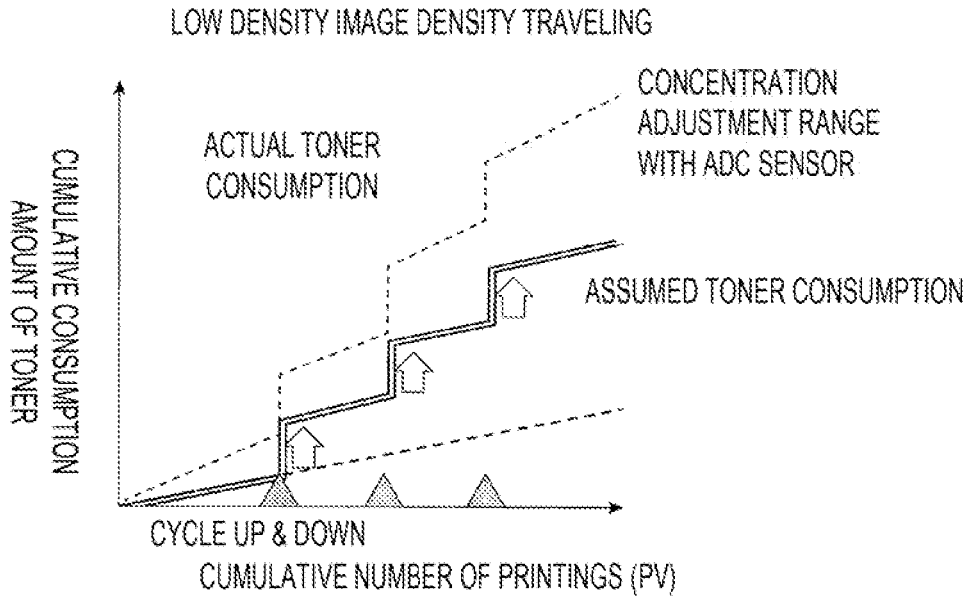
FIG. 10 is a graph illustrating a relationship between a cumulative number of printings and a cumulative consumption amount of toner in the image forming apparatus according to the first exemplary embodiment of the present disclosure.

Therefore, as illustrated in FIG. 10, in the above image forming apparatus 1, even in a case where the image forming operation with a low image density is continuously executed, the toner is replenished by predicting (assuming) the toner to be consumed due to the start and the stop of the print job, and thus, it is possible to prevent or suppress the decrease in image density due to insufficient replenishment of the toner.

Second Exemplary Embodiment

Figure 11:
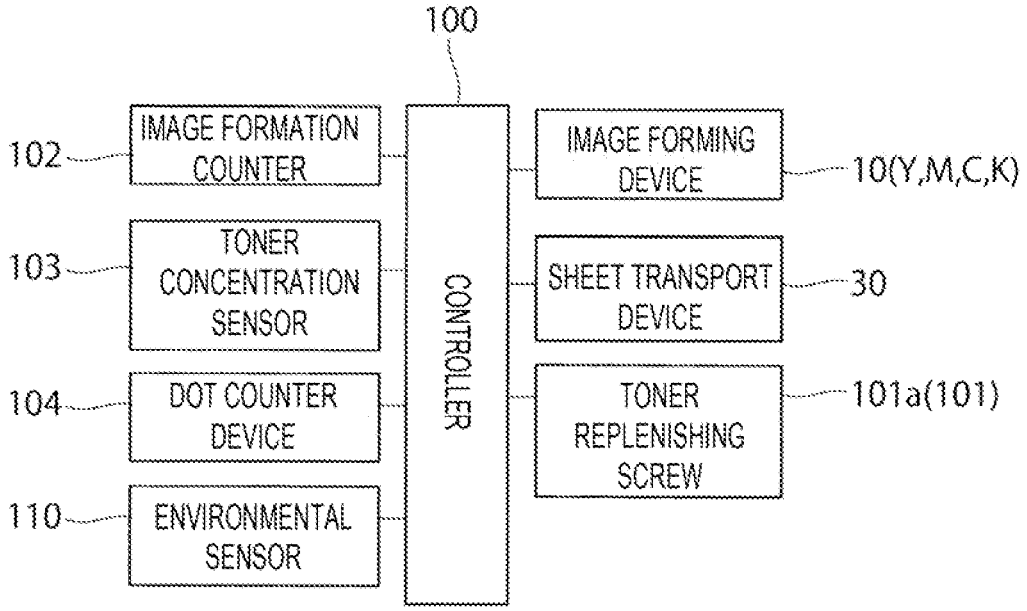
FIG. 11 is a block diagram illustrating a controller of an image forming apparatus according to a second exemplary embodiment of the present disclosure.

FIG. 11 is a block diagram illustrating a controller of an image forming apparatus according to a second exemplary embodiment of the present disclosure.

As illustrated in FIG. 11, the image forming apparatus 1 according to the second exemplary embodiment includes an environmental sensor 110 that detects temperature and humidity as an example of an environment detector that detects environmental conditions in which the image forming apparatus 1 is provided. The developer supply unit corrects the amount of the developer consumed apart from the developer consumed in the image formation in accordance with the detection result of the environmental sensor 110.

That is, the controller 100 of the image forming apparatus 1 according to the second exemplary embodiment detects the temperature and the humidity of the environment in which the image forming apparatus 1 is provided detected by the environmental sensor 110.

Then, the controller 100 determines whether it is normal temperature and normal humidity, high temperature and high humidity, or low temperature and low humidity, based on the temperature and the humidity of the environment detected by the environmental sensor 110.

When it is determined that the temperature is high and the humidity is high based on the temperature and the humidity of the environment detected by the environmental sensor 110, in FIG. 7, when the pixels corresponding to fogging are added, the controller 100 changes the added value of the pixels corresponding to fogging to a larger value than the normal (normal temperature and normal humidity) value.

As described above, in the image forming apparatus 1 according to the second exemplary embodiment, when it is determined that the temperature and the humidity in the environment in which the image forming apparatus 1 is provided, which is detected by the environmental sensor 110, are high temperature and high humidity, the added value of the pixels corresponding to fogging is changed to a larger value than the normal value (normal temperature and normal humidity). Therefore, even when the fogging toner adhering to the surface of the photoconductor drum 11 at the start and the end of the print operation and consumed at high temperature and high humidity increases, it is possible to replenish the toner corresponding to the increase in the fogging toner.

Since other configurations and operations are the same as those in the first exemplary embodiment, the description thereof is omitted.

Third Exemplary Embodiment

Figure 12:
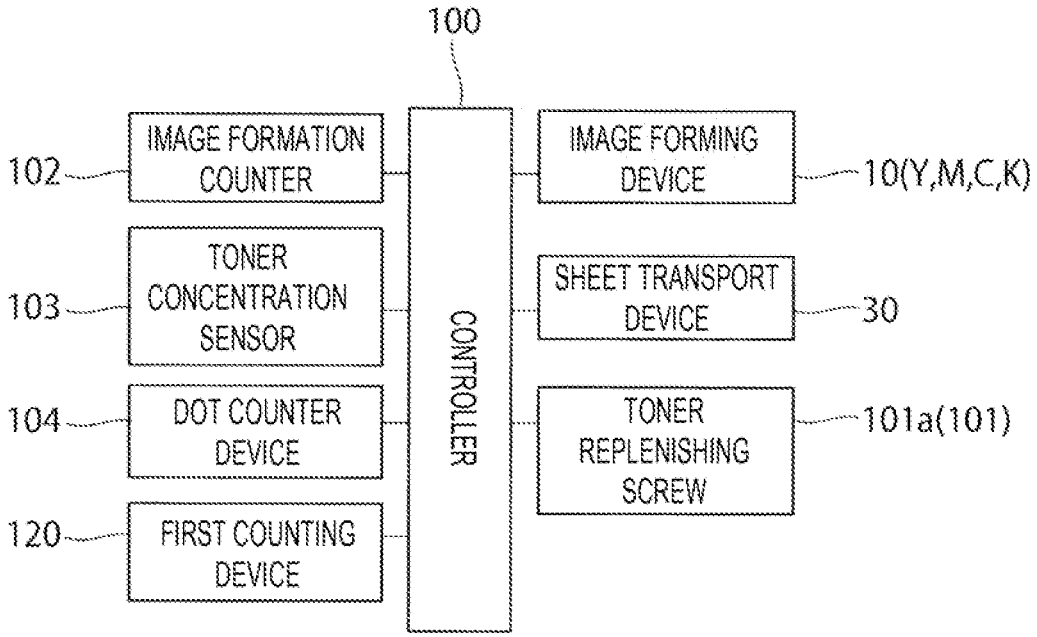
FIG. 12 is a block diagram illustrating a controller of an image forming apparatus according to a third exemplary embodiment of the present disclosure.

FIG. 12 is a block diagram illustrating a controller of an image forming apparatus according to a third exemplary embodiment of the present disclosure.

As illustrated in FIG. 12, the image forming apparatus 1 according to the third exemplary embodiment includes a first counting device 120 that cumulatively counts the number of rotations of the developing roller 141, as an example of a first usage history detector that detects a usage history of the developing unit.

The first counting device 120 does not necessarily count the number of rotations of the developing roller 141 directly, and may indirectly count the number of rotations of the developing roller 141 based on the size of the image developed by the developing device 14.

The controller 100 determines whether or not the number of rotations of the developing roller 141 is equal to or less than the required threshold value by the first counting device 120, and when it is determined that the number of rotations of the developing roller 141 exceeds the required threshold value, changes the added value of the pixels corresponding to fogging, which corresponds to the normal case where the number of rotations of the developing roller 141 is equal to or less than the required threshold value, to a larger value than the normal value, when the pixels corresponding to fogging are added in FIG. 7.

As described above, in the image forming apparatus 1 according to the third exemplary embodiment, the number of rotations of the developing roller 141 is cumulatively counted by the first counting device 120, and the added value of the pixels corresponding to fogging, which corresponds to the normal case where the number of rotations of the developing roller 141 is equal to or less than the required threshold value, is changed to a larger value than the normal value. Therefore, even when the number of rotations of the developing roller 141 exceeds the required threshold value and the developer 4 deteriorates, and the amount of the fogging toner consumed increases, it is possible to replenish the toner corresponding to the increase in the fogging toner.

Since other configurations and operations are the same as those in the first exemplary embodiment, the description thereof is omitted.

Fourth Exemplary Embodiment

Figure 13:
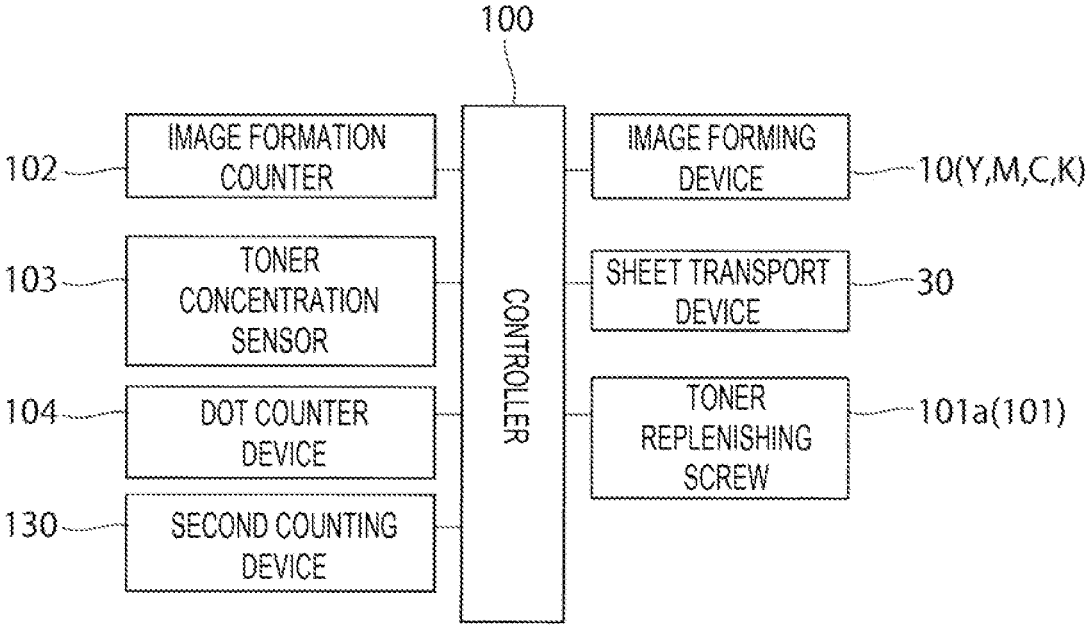
FIG. 13 is a block diagram illustrating a controller of an image forming apparatus according to a fourth exemplary embodiment of the present disclosure.

FIG. 13 is a block diagram illustrating a controller of an image forming apparatus according to a fourth exemplary embodiment of the present disclosure.

The image forming apparatus 1 according to the fourth exemplary embodiment includes a second usage history detector that detects the usage history of the image carrier. The developer supply unit corrects the amount of the developer consumed apart from the developer consumed in the image formation in accordance with the detection result of the second usage history detector.

Further, in the image forming apparatus 1 according to the fourth exemplary embodiment, the developer supply unit corrects the amount of the developer consumed apart from the developer consumed in the image formation to be increased as the detection result of the second usage history detector increases.

That is, as illustrated in FIG. 13, the image forming apparatus 1 according to the fourth exemplary embodiment includes a second counting device 130 that cumulatively counts the number of rotations of the each photoconductor drum 11, as an example of the second usage history detector that detects the usage history of each photoconductor drum 11 serving as an image carrier.

The second counting device 130 does not necessarily count the number of rotations of each photoconductor drum 11 directly, and may indirectly count the number of rotations of each photoconductor drum 11 based on the size of the recording sheet 5 on which an image is formed by the photoconductor drum 11.

The controller 100 determines whether or not the number of rotations of the photoconductor drum 11 is equal to or less than the required threshold value by the second counting device 130, and when it is determined that the number of rotations of the photoconductor drum 11 exceeds the required threshold value, in FIG. 7, changes the added value of the pixels corresponding to fogging, which corresponds to the normal case where the number of rotations of the photoconductor drum 11 is equal to or less than the required threshold value, to a larger value than the normal value, when the pixels corresponding to fogging are added.

As described above, in the image forming apparatus 1 according to the fourth exemplary embodiment, the number of rotations of the photoconductor drum 11 is cumulatively counted by the second counting device 130, and the added value of the pixels corresponding to fogging, which corresponds to the normal case where the number of rotations of the photoconductor drum 11 is equal to or less than the required threshold value, is changed to a larger value than the normal value. Therefore, even when the number of rotations of the photoconductor drum 11 exceeds the required threshold value and the photoconductive layer of the photoconductor drum 11 is worn, and the amount of the fogging toner consumed increases, it is possible to replenish the toner corresponding to the increase in the fogging toner.

Since other configurations and operations are the same as those in the first exemplary embodiment, the description thereof is omitted.

In the above exemplary embodiments, the image forming apparatus that forms a full-color image as an example of an image forming apparatus has been described. It is noted that the present disclosure is not limited thereto. Of course, an image forming apparatus that forms a black-and-white image may be used as the image forming apparatus.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier configured to carry an image;

a developing unit configured to develop the image carried by the image carrier with a developer; and a developer replenishing unit configured to supply the developer to the developing unit, the developer replenishing unit being configured to predict, in advance, an amount of developer consumed by the image carrier at a start or an end of image formation apart from developer consumed in the image formation, to replenish the predicted amount of the developer.

2. The image forming apparatus according to claim 1, wherein the developer replenishing unit is configured to predict, in advance, the amount of the developer consumed by the image carrier at the start or the end of the image formation apart from the developer consumed in the image formation, in accordance with characteristics of the developer, to replenish the predicted amount of the developer.

3. The image forming apparatus according to claim 1, wherein the developer replenishing unit is configured to, when a density of the image carried by the image carrier is equal to or less than a predetermined density, predict, in advance, the amount of the developer consumed apart from the developer consumed in the image formation to replenish the predicted amount of the developer.

4. The image forming apparatus according to claim 2, wherein the developer replenishing unit is configured to, when a density of the image carried by the image carrier is equal to or less than a predetermined density, predict, in advance, the amount of the developer consumed apart from the developer consumed in the image formation to replenish the predicted amount of the developer.

5. The image forming apparatus according to claim 1, wherein the developer replenishing unit comprises:

a detector configured to detect pixel information of the image carried by the image carrier and a concentration of the developer in the developing unit or a density of the image developed by the developing unit.

6. The image forming apparatus according to claim 5, further comprising:

an environment detector configured to detect environmental conditions in which the image forming apparatus is installed, wherein the developer replenishing unit is configured to correct the amount of the developer consumed apart from the developer consumed in the image formation in accordance with a detection result of the environment detector.

7. The image forming apparatus according to claim 1, further comprising:

a first usage history detector configured to detect a usage history of the developing unit, wherein the developer replenishing unit is configured to correct the amount of the developer consumed apart from the developer consumed in the image formation in accordance with a detection result of the first usage history detector.

8. The image forming apparatus according to claim 7, wherein the developer replenishing unit is configured to correct the amount of the developer consumed apart from the developer consumed in the image formation, to be increased as the detection result of the first usage history detector increases.

9. The image forming apparatus according to claim 1, further comprising:

a usage history detector configured to detect usage history of the image carrier, wherein the developer replenishing unit is configured to correct the amount of the developer consumed apart from the developer consumed in the image formation in accordance with a detection result of the usage history detector.

10. The image forming apparatus according to claim 9, wherein the developer replenishing unit is configured to correct the amount of the developer consumed apart from the developer consumed in the image formation, to be increased as the detection result of the usage history detector increases.

11. An image forming apparatus comprising:

image carrying means for carrying an image;

developing means for developing the image carried by the image carrying means with a developer; and replenishing means for supplying the developer to the developing means, the replenishing means for predicting, in advance, an amount of developer consumed by the image carrying means at a start or an end of image formation apart from developer consumed in the image formation, to replenish the predicted amount of the developer.

* * * * *